United States Patent [19]

Goldsberry

[11] Patent Number: 4,741,398

[45] Date of Patent: May 3, 1988

[54] HYDRAULIC ACCUMULATOR-COMPRESSOR FOR GEOPRESSURED ENHANCED OIL RECOVERY

[75] Inventor: Fred L. Goldsberry, Spring, Tex.

[73] Assignee: The United States of America as represented by the United States Department of Energy, Washington, D.C.

[21] Appl. No.: 947,714

[22] Filed: Dec. 30, 1986

[51] Int. Cl.[4] ..... E21B 43/40

[52] U.S. Cl. ..... 166/266; 60/641.2; 166/53; 166/267; 166/268; 417/101

[58] Field of Search ..... 166/267, 266, 268, 370, 166/369, 75.1, 53, 54; 417/101, 92; 55/43, 46, 55, 189; 60/641.2, 641.3, 641.4, 641.5

[56] References Cited

U.S. PATENT DOCUMENTS

| | | | |
|---|---|---|---|
| 2,626,740 | 1/1953 | Levy | 417/101 |
| 2,875,833 | 3/1959 | Martin | 166/268 |
| 2,937,140 | 5/1960 | Stinson | 55/55 |
| 3,149,668 | 9/1964 | Arendt | 166/266 |
| 3,442,332 | 5/1969 | Keith | 166/267 X |
| 3,743,444 | 7/1973 | Kazama et al. | 417/92 |
| 3,782,468 | 1/1974 | Kuwada | 166/267 |
| 4,130,403 | 12/1978 | Cooley et al. | 166/267 X |
| 4,273,189 | 6/1981 | Carpenter | 166/267 X |
| 4,319,635 | 3/1982 | Jones | 166/267 X |
| 4,643,650 | 2/1987 | Khakzad-Ghomi | 417/101 X |

*Primary Examiner*—James A. Leppink
*Assistant Examiner*—Hoang C. Dang
*Attorney, Agent, or Firm*—L. E. Carnahan; Roger S. Gaither; Judson R. Hightower

[57] ABSTRACT

A hydraulic accumulator-compressor vessel using geothermal brine under pressure as a piston to compress waste ($CO_2$ rich) gas is used in a system having a plurality of gas separators in tandem to recover pipeline quality gas from geothermal brine. A first high pressure separator feeds gas to a membrane separator which separates low pressure waste gas from high pressure quality gas. A second separator produces low pressure waste gas. Waste gas from both separators is combined and fed into the vessel through a port at the top as the vessel is drained for another compression cycle. High pressure brine is then admitted into the vessel through a port at the bottom of the vessel. Check valves control the flow of low pressure waste gas into the vessel and high pressure waste gas out of the vessel.

4 Claims, 1 Drawing Sheet

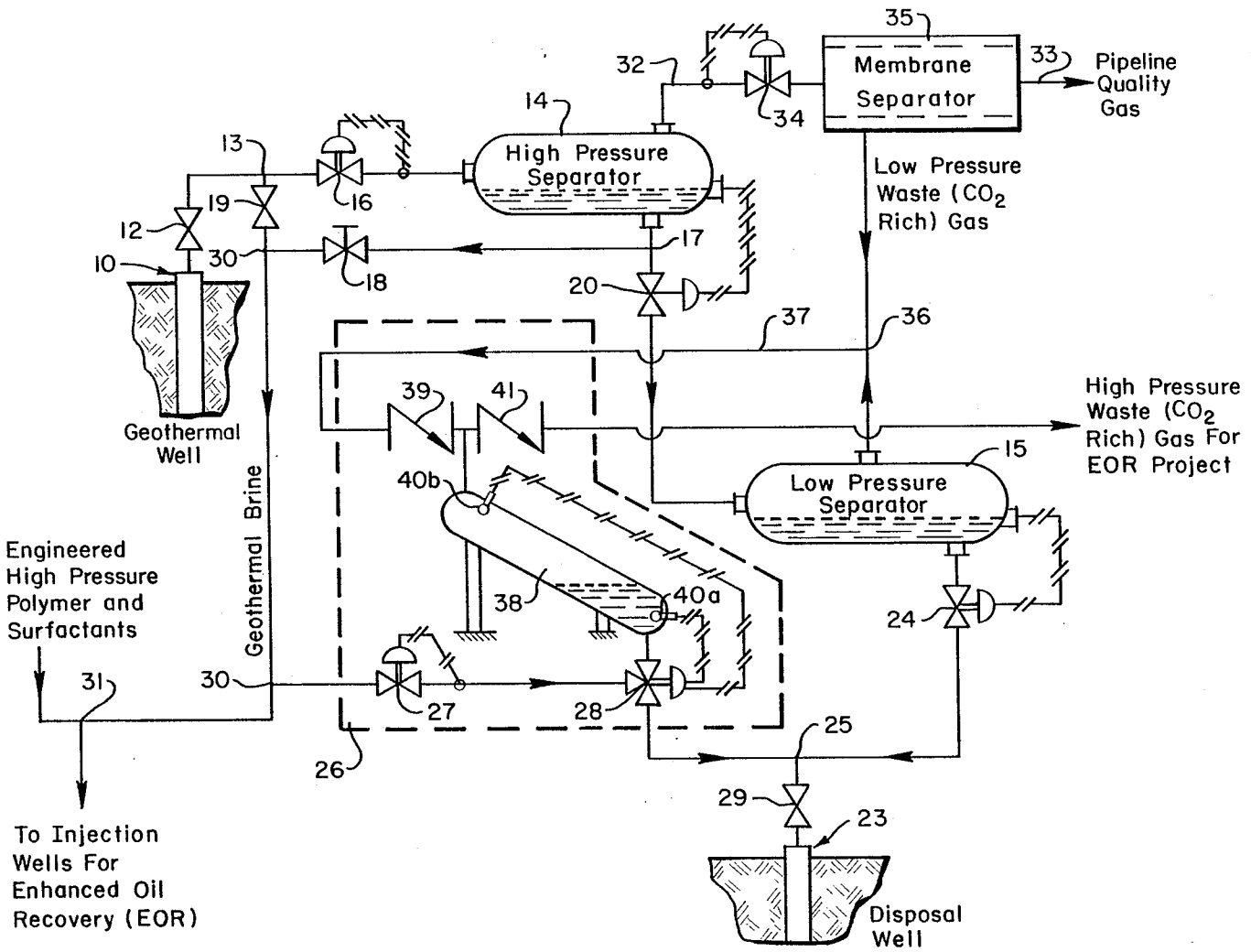
Pipeline Quality Gas
33
35
Membrane Separator
Low Pressure Waste ($CO_2$ Rich) Gas
36
High Pressure Waste ($CO_2$ Rich) Gas For EOR Project
15
Low Pressure Separator
24
Disposal Well
23
25
29
34
37
32
14
High Pressure Separator
17
20
40a
28
41
38
39
40b
27
16
18
26
13
19
30
Geothermal Brine
12
10
Geothermal Well
Engineered High Pressure Polymer and Surfactants
31
To Injection Wells For Enhanced Oil Recovery (EOR)

HYDRAULIC ACCUMULATOR-COMPRESSOR FOR GEOPRESSURED ENHANCED OIL RECOVERY

BACKGROUND OF THE INVENTION

This invention relates generally to a hydraulic accumulator-compressor, and more particularly to a hydraulic accumulator-compressor in geothermal power control systems having as an objective producing engineered fluids for enhanced oil recovery from geopressured geothermal power and enhanced natural gas recovery from the well fluid.

Economic production of oil from an underground formation becomes impossible when the reservoir pressure drops below a certain level. When that occurs it has become the practice to employ one or more methods of secondary and tertiary oil recovery. These methods try to provide a new driving force to displace oil from rock formations toward adjacent production wells in the same field. The techniques have centered upon engineered floods of natural gas, $CO_2$, water, and polymer aqeous solutions for the purpose of (1) physically changing the properties of oil (density, viscosity, surface tension and wetting characteristics), and (2) in uniformly sweeping it through the reservoir.

Compared with water flooding, miscible flooding is the more sophisticated technique for oil displacement. The oil is diluted with natural gas, $CO_2$ or other light hydrocarbons in order to reduce viscosity and increase mobility of the oil. The more expensive miscible flooding is usually followed by a mixture of water and surfactant (detergent, ammonia, etc.). A diffusion front (oil saturation bank) is caused by the first miscible flooding and formed near the injection well. Remaining oil droplets are mobilized by the surfactant and water to complete the oil bank that sweeps the remaining reservoir oil through the rock to production wells. At the end polymerized water (micellar polymer), with high viscosity and the ability to maintain a stable and uniform flood front, is pumped into the injection well as a sweep or displacement mechanism. Performance of the system will increase when all fluids are heated because the miscible phase is more soluble, the fluid viscosities are reduced, and the surfactant has better cleaning or wetting properties.

Instead of pumping the fluids to displace oil from reservoir rocks, it is more economic to use the hydraulic energy available in a geopressured aquifer. These concepts have centered upon using hot brine as a motive force behind the engineered fluids. Geopressured wells of commercial productivity (i.e., 10–40,000 BPD for ten years) are not likely to be found at the same level as productive oil and gas wells. These levels are usually highly faulted producing small structural traps. In productive areas, wells are often drilled to great depths in search of oil and gas only to locate water saturated sands. That happens more often than not. But during the life of the productive field, one can expect a deeper test well, and it will almost certainly reveal some geopressured brine zone that has more than enough fluid under pressure to sweep an existing pressure depleted oil field.

In most cases, artificial floods are composed of engineered fluids of specified compositions and injected at controlled rates. The objective of such flooding is to design a general process for enhanced oil recovery utilizing the hydraulic and thermal energy of geopressured geothermal brine resources as a means for offsetting the cost of the water flood. The invention described in U.S. Pat. No. 4,484,446 by the present inventor was made in satisfaction of that objective.

Another objective of the exploitation of geopressured geothermal energy resource fluids is an outgrowth of the shortage of natural gas in recent years. Brine is typically saturated with natural gas in quantities of from thirty to fifty standard cubic feet per barrel (5.34–8.91 $m^3$ gas/$m^3$ (brine) at 250° F. to 450° F. (395 K to 505 K). The large extent of that resource has prompted various estimates of recoverable gas reserves that could extend the U.S. reserve life index as much as two hundred years. The present invention addresses the need to recover the natural gas as well as the production of engineered fluids.

SUMMARY OF THE INVENTION

In its broadest aspect, this invention relates to a method for the pressurization of gas with a high pressure liquid source. For the compression of low pressure gas, the system requires approximately 10% of the hydraulic energy of the source.

In a more particular sense, this invention is concerned with a method for producing engineered fluids along with saleable natural gas from a geopressured geothermal brine source.

In accordance with the invention, a high pressure liquid resource works in a vessel like a moving piston for the compression of gas. Once the pressurized gas has been evacuated from the vessel, the liquid is evacuated and, at the same time, a new supply of low pressure gas is drawn into the vessel. The vessel may be vertical with check valves for the low pressure inlet and high pressure outlet pipelines at the top, and control valves for the liquid at the bottom of the vessel.

For a long, high volume capacity stroke without excessive height, and to increase the hydraulic performance upon evacuation of the liquid, the vessel may be cylindrical, with its axis at an acute angle with the horizontal. The invention may use two or more stages in tandem, in which case the use of smaller high pressure vessels makes utilization of the high pressure liquid more efficient.

In accordance with another aspect of this invention, the liquid piston is used to advantage in the production of engineered fluids for flooding in oil and gas reservoirs. Thus, one application of the present invention comprises the process for the pressurization of gas in a process for producing engineered fluids for flooding oil reservoirs. An important advantage, besides the production of saleable natural gas in a very economic way, and the economic production of engineered fluids for secondary and tertiary oil recovery, is that the process requires a minimum of surface equipment.

BRIEF DESCRIPTION OF THE DRAWING

The sole FIGURE is a schematic diagram of the invention in a system for the production of engineered fluids for secondary and tertiary recovery of oil along with the production of saleable natural gas from a geopressured geothermal brine resource.

DESCRIPTION OF A PREFERRED EMBODIMENT

As previously pointed out this invention is concerned with the recovery of natural gas from geopressured geothermal brine, and the production of engineered fluids for flooding secondary and tertiary recovery of oil. More specifically it concerns a simple hydraulic system for accomplishing pressurization of gas recovered from geothermal brine while utilizing the high pressure brine for flooding. A schematic diagram of a preferred embodiment is shown in the drawing as part of an enhanced oil recovery system (EOR).

High pressure brine is produced at a high temperature by a geothermal production well indicated generally at 10. After passing a master check valve 12, the brine is divided by a tee at 13 into a first system for the recovery of high pressure pipeline quality natural gas and into a second high pressure liquid supply line system. In the first system the brine feeds two separators 14, 15 in tandem. Pressure reduction is imposed on the brine in these separators, thereby enabling separation of gas from the brine, by controlling the liquid level.

The inlet pressure for the high pressure separator 14, operating above the pressure level of the quality gas pipeline, is adjusted to a desired level, for example, of 1200 psi by a pressure reduction valve 16. After the first separator 14, the brine passes another toe at 17 with connections to the high pressure liquid supply system and the second separator 15. Valve 18 is an optional manual valve that allows redirection of flow in the event the operator wishes to work on other components without shutting the well down at the master valve 12. A check valve may be used in conjunction with a manual block valve to assure direction of flow while the block valve is open. Then, under normal operation, the check valve is closed, but if geopressure should momentarily drop, this check valve will open, and a check valve 19 in the high pressure liquid supply line is closed. It is thus possible to provide continuous liquid under high pressure in the injection well liquid supply line from the high pressure separator in the event the geothermal pressure from the production well momentarily drops below the pressure of the pressure reduction valve 16.

A level control valve 20, maintains the brine level in the high pressure separator 14, and passes the excess brine into the low pressure separator 15. In both separators, 14 and 15, the gas in the brine evaporates into a lower pressure level. The low pressure separator 15 has a lower pressure level imposed on the brine than a high pressure separator 14. Nevertheless, the outlet pressure of the low pressure separator 15, of about 100 psi, is higher than that of a disposal well indicated at 23, so that the brine is forced to drain.

The brine level is maintained in the low pressure separator 15 by a level control valve 24. After this valve, the brine passes to the disposal well 23 through a tee at 25 with a branch to a hydraulic accumulator-compressor enclosed in a dotted line box 26. While the hydraulic accumulator-compressor is being filled through valves 27 and 28, the low pressure brine flows directly through a master check valve 29 into the disposal well 23.

The function of the injection well liquid supply line, operating at a high pressure level, is to supply not only the injection well but also the hydraulic accumulator-compressor with high pressure brine. This high pressure injection line is fed through the check valve 19 or the valve 18. In either case, division of the brine into two streams is achieved by means of a tee at 30. Another tee at 31 in the piping nearer to the injection wells can be used to inject engineered high pressure polymer and surfactant additions to the high pressure, high temperature brine fed into the injection wells. The line for these additions may include control valves, such as check valves to assure direction of flow. Normal oil field practice is to eliminate control valves and use pipeline regulated pressure for control.

Gas is separated in both separators 14 and 15. In the gas outlet pipe 32 from the high pressure separator 14, the pressure (about 600 psi) is above the pressure of a pipeline quality gas output pipeline 33. A pressure control valve 34 regulates the gas pressure for a membrane separator 35. In this membrane separator, the gas is separated into high pressure pipeline quality gas and low pressure waste gas with about 25% $CO_2$ content. The low pressure separator 15 produces low pressure gas with about 50% $CO_2$ content. Both low pressure gasses are combined in a tee at 36 to produce a flash gas with high $CO_2$ content. The low pressure side of the membrane separator 35 is intended to "float" at the pressure setting of the low pressure separator 15 which "floats" at the pressure of pipeline 33. The pipeline pressure controls the relative quantities of high pressure pipeline gas to low quality, low pressure waste gas. The membrane in the membrane separator 35 has the same function as a check valve.

A check valve can be installed on the gas outlet of the low pressure separator 15 but is not necessary. The low pressure separator can function as a surge tank in the absence of a check valve. Thus, the preferred embodiment is without a check valve. Normally flow from the membrane separator to the tee 36 will bypass the separator 15. It is also desirable to inject the gas from the membrane separator 35 directly into the low pressure separator 15 to knock out any water condensate that forms.

The combined low pressure gases at the tee 36 feed the input line 37 of the hydraulic accumulator-compressor where it is compressed to a higher pressure for use in an injection well as part of an enhanced oil recovery system. If necessary, a second stage of compression may be added in tandem. Alternatively, the compressed waste ($CO_2$ rich) gas may be directed to another system for purification to pipeline quality gas.

The operation of the hydraulic accumulator-compressor can be described as follows. Assume that a vessel 38 is filled with waste gas, passed through a low pressure check valve 39, and that the liquid in the vessel 38 is at a low level. From the tee at 30 in the liquid supply line, high pressured brine is diverted to the pressure reduction valve 27 and to the 2-way control valve 28. Due to the low liquid level in the gas compression vessel 38, a lower float switch **40*a* generates a signal to the 2-way valve 28 to connect the vessel 38 with the high pressure liquid from the pressure reduction valve 27. The liquid level rises in the vessel 38 and acts as a piston to increase the pressure of gas in the vessel and force it through a check valve 41 as high pressure waste gas directed to an enhanced oil recovery project or to a second stage compression or purification system. When the brine level in the vessel 38 reaches a higher float switch 40*b*, a signal is transmitted to the 2-way valve 28 to connect the vessel 38 to the disposal well 23. Once the liquid drains into the disposal well, the gas pressure in the vessel 38 decreases, and the high pressure check valve 41 closes. At the same time, the low pressure check valve 39 opens to admit into the vessel 38 waste gas in the pipeline 37**.

The force draining the liquid in the vessel 38 is gravity, and the low pressure gas from the tee at 36 is at a pressure sufficient to fill the vessel 38 as the liquid is evacuated. When the surface of the liquid reaches the lower float switch 40*a*, the 2-way valve 28 is again caused to connect the vessel 38 to the pressure reduction valve 27, and the hydraulic accumulator-compressor repeats another cycle.

HYPOTHETICAL EXAMPLE

Assume a reservoir productive of oil and gas at a depth of 8,000 ft. in a small (200 acre) fault block. Also assume a test well drilled after twenty years of production to a depth of 18,000 ft. to test a lower horizon for natural gas. The deep hole is plugged back at the bottom of an intermediate casing at 13,000 ft. This intermediate casing intersects an overpressured sand at 12,750 ft. According to electric logs and drilling records it is expected to be productive of brine.

It has been established by research efforts that this brine will be saturated with natural gas (30 SCF/BBL) of which 5 to 10% will be $CO_2$. The operator also has a production well that has watered out and that may be used as a salt water disposal well. It is known to be capable of receiving 2,000 BPD without any back pressure at the surface.

The operator can now begin (1) a pressure maintenance program, (2) a five spot pattern injection operation, or (3) a $CO_2$ injection and polymer flood in the watered out wells to aid in sweeping the remainder of the oil from the reservoir.

The operator can then take these actions:

(1) Reenter the abandoned deep well, run a production packer on a string of tubing. The well is then perforated and tested for productivity into a portable tank.
(2) Lay a small flow line to the disposal well for proper (legal) disposal of excess or energy depleted brine.
(3) Install the geopressure hybrid energy production facility to be described herein and connect the proper gas sales and/or gas/water injection lines to designated wells.
(4) As prudent engineering of the $CO_2$/water flood is pursued, the fluids produced for injection are varied to meet the requirements of the job.

The material balance for such a system can be worked out readily on a 1,000 BBL basis. Assume a brine with 30 SCF/BBL of recoverable gas which is 7% $CO_2$. Approximately 24 SCF/BBL is recovered on the high pressure side at 1,000 psia. The membrane gas loss will be approximately 4 SCF with an additional 4 SCF recovered from the low pressure flash at 200 psi.

| | | ACTUAL VOLUME |
|---|---|---|
| FLUID: | 1 BBL | 5.615 $FT^3$ |
| GAS: | 8 SCF @ 200 PSIA | .588 $FT^3$ |
| | @ 1,000 | .1176 $FT^3$ |

An hydraulic accumulator-compression unit requires approximately 10.5% of the brine flow to compress the gas back to pipeline pressure. The low pressure high $CO_2$ gas production from this system can be recompressed using the mechanical energy in 10% of the brine. The approximately daily volumes of gas in this case will be:

20 MCFD ---- Saleable Fuel Gas or Injection
10 MCFD ---- Injection or Sweep Gas.

Actual swept volume in 24 hours will be 588 $FT^3$ per thousand barrels. Pump fluid required is 105 BBL per thousand produced.

| | VESSEL SIZE | VOLUME | CYCLES/ DAY | BBL/ CYCLE |
|---|---|---|---|---|
| (1) | 3 FT. DIA 12' HIGH | 84 $FT^3$ | 7 | 15 |
| (2) | 2.0 FT. DIA 8' HIGH | 25.12 $FT^3$ | 24 | 4.5 |
| (3) | 1.5 FT. DIA 6' HIGH | 10.6 $FT^3$ | 56 | 1.9 |

In the case of a large flow rate of 20,000 BPD the 3'×12' vessel would cycle 140 times or once every ten minutes consuming 2,100 BPD. This will allow recompression of the low BTU gas for subsequent recovery of high purity $CO_2$ and more pipeline gas. A two unit system would allow continuous intake cycles although this may not be necessary if the volume of the low pressure separator is resonably large. A fluctuation of pressure in the low pressure separator can be reduced by shortening the cycle time or increasing gas volume ahead of the accumulator or both. The majority of the hydraulic energy in the brine remains available for water flood or driving a hydraulic turbine.

Many modifications and variations in the apparatus and process set forth will be possible without departing from the scope and spirit of the invention. For example it should be noted that the hydraulic accumulator-compressor is not restricted to use in an enhanced oil recovery (EOR) system, as disclosed herein. It may also be used wherever a high pressured liquid source is available, and a low pressured gas is to be compressed. The following claims should therefore be interpreted to compress all these modifications and variations.

What is claimed is:

1. Apparatus for pressurization of low pressure, $CO_2$ rich, waste gas for use in an enhanced oil recovery system from a system for recovering pipeline quality gas from geopressured geothermal brine, said pressurization apparatus using said geothermal brine comprising a pipeline connected to a geopressured geothermal well, a vessel having a first end lower than a second end, and having its axis at an acute angle with respect to the horizontal, means at said first end of said vessel for sensing a low geothermal brine level in said vessel, and producing a first signal in response thereto, means at said second end of said vessel for sensing a high geothermal brine level in said vessel, and producing a second signal in response thereto, a pipeline with a check valve for admitting said low pressure, $CO_2$ rich, waste gas from said gas source into said vessel at said second end, a pipeline with a check valve for carrying high pressure, $CO_2$ rich, waste gas from said vessel at said second end, a pipeline for disposing of liquid connected to said vessel at said first end, and valve means for connecting said first end of said vessel to said geopressured geothermal well pipeline in response to said first signal, and for connecting said first end of said vessel to said disposal pipeline in response to said second signal.

2. Apparatus as defined in claim 1 wherein said apparatus for recovering pipeline quality gas from geopressured geothermal brine is comprised of two gas separator vessels for separating gas from said brine by evaporation, one at high pressure and one at low pressure, said gas separator vessels being connected in series for geothermal brine flow between said geopressured geothermal well pipeline and said disposal pipeline, each gas separator vessel having means for limiting geothermal brine level for broad surface exposure into at least half the gas separator vessel, a membrane separator for separating quality gas from gas separated out of said geothermal brine in said first separator vessel, and emitting low pressure, $CO_2$ rich waste gas, and pipelines connected by a tee to combine said waste gas from said membrane separator with gas separated out of said geothermal brine in said second separator vessel as $CO_2$ rich waste gas to be pressurized by said pressurization apparatus.

3. A method for geothermal enhanced oil recovery comprising the steps of extracting geopressured geothermal brine from a well, separating natural gas from said brine by vaporization in a vessel through which said brine is processed, separating high quality pipeline gas from said natural gas and pressurizing the residual waste gas having a high percentage of $CO_2$ for enhanced oil recovery, wherein said pressurizing of waste gas consists of compressing said waste gas in a vessel with geopressured geothermal brine.

4. A method as defined in claim 3 wherein separation of natural gas is accomplished in at least two steps with the second producing only waste gas having a high percentage of $CO_2$, and combining the waste gas from said second step with waste gas from said first step for use in enhanced oil recovery.

* * * * *